US009267703B2

(12) United States Patent
Collins

(10) Patent No.: US 9,267,703 B2
(45) Date of Patent: Feb. 23, 2016

(54) METHOD OF GENERATING HEAT

(71) Applicant: Mark Collins, East Sussex (GB)

(72) Inventor: Mark Collins, East Sussex (GB)

( * ) Notice: Subject to any disclaimer, the term of this patent is extended or adjusted under 35 U.S.C. 154(b) by 0 days.

(21) Appl. No.: 14/282,719

(22) Filed: May 20, 2014

(65) Prior Publication Data

US 2014/0360441 A1 Dec. 11, 2014

Related U.S. Application Data

(63) Continuation of application No. 12/528,255, filed as application No. PCT/GB2008/000630 on Feb. 25, 2008, now abandoned.

(30) Foreign Application Priority Data

Feb. 23, 2007 (GB) ..... 0703612.2

(51) Int. Cl.
*F24J 1/00* (2006.01)
*F24H 1/12* (2006.01)
*F24H 9/20* (2006.01)

(52) U.S. Cl.
CPC ..... *F24H 1/12* (2013.01); *F24H 9/2007* (2013.01); *F24J 1/00* (2013.01)

(58) Field of Classification Search
CPC ..... F24J 1/00; F24J 3/00
USPC ..... 126/263.01, 263.03
See application file for complete search history.

(56) References Cited

U.S. PATENT DOCUMENTS

| | | | | |
|---|---|---|---|---|
| 2,393,909 | A * | 1/1946 | Johnson | 518/712 |
| 3,482,948 | A | 12/1969 | Miegel | |
| 3,558,588 | A | 1/1971 | Gray | |
| 3,563,226 | A | 2/1971 | Rockenfeller et al. | |
| 3,756,933 | A | 9/1973 | Green et al. | |
| 3,756,993 | A * | 9/1973 | Green et al. | 528/388 |
| 3,768,955 | A | 10/1973 | McLaughlin | |
| 4,044,821 | A | 8/1977 | Fletcher et al. | |
| 4,325,355 | A | 4/1982 | Houser | |
| 2002/0134321 | A1 | 9/2002 | Alix et al. | |
| 2004/0065315 | A1 | 4/2004 | Fish et al. | |

FOREIGN PATENT DOCUMENTS

| | | | |
|---|---|---|---|
| DE | 3539710 | A1 | 5/1987 |
| GB | 2381187 | A | 4/2003 |
| WO | 8601880 | A | 3/1986 |
| WO | 2004040645 | A | 5/2004 |

OTHER PUBLICATIONS

International Search Report for PCT/GB2008/000630 dated Jul. 15, 2008.

* cited by examiner

*Primary Examiner* — Avinash Savani
(74) *Attorney, Agent, or Firm* — Heslin Rothenberg Farley and Mesiti, P.C.

(57) ABSTRACT

The invention provides a method for producing a supply of a heated fluid, which method comprises passing the fluid through a heat exchanger unit where it is heated by a heat source; characterized in that the heat source derives heat from the exothermic reaction of two or more chemical reactants. The chemical reactants are preferably an acid and a base.

16 Claims, 1 Drawing Sheet

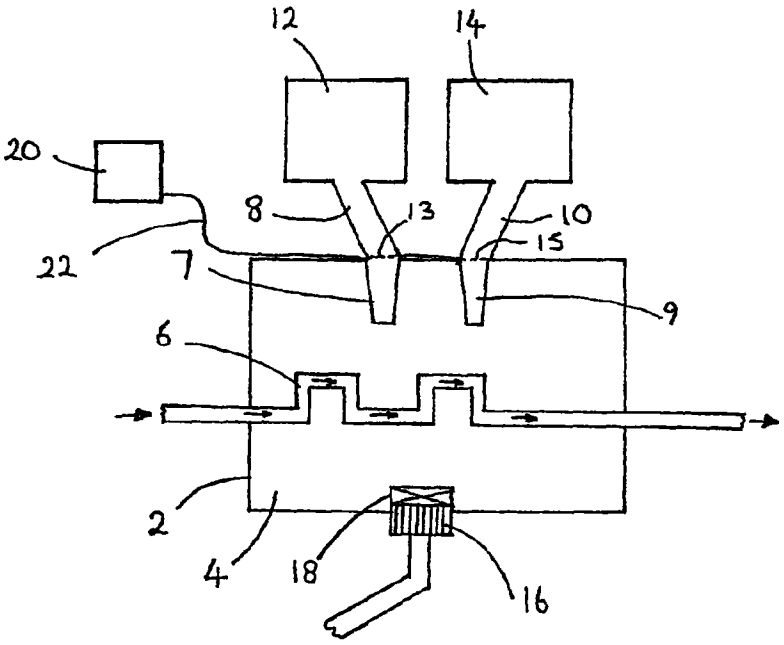
20
22
12
8
7
14
13
6
10
15
9
2
4
18
16

METHOD OF GENERATING HEAT

CROSS REFERENCE TO RELATED APPLICATIONS

This application is a continuation application of U.S. patent application Ser. No. 12/528,255, filed on Aug. 21, 2009. U.S. patent application Ser. No. 12/528,255 is a §371 national stage filing of PCT International Application No. PCT/GB2008/000630 filed on Feb. 25, 2008 and published in English on Aug. 28, 2008 as PCT publication WO 2008/102164 A1, which claims the benefit of priority from British application number GB 0703612.2, filed on Feb. 23, 2007. The entire disclosures of each of these prior applications are incorporated herein by reference.

FIELD OF THE INVENTION

This invention relates to a method of generating heat for use in a heating system and in particular a domestic heating system

BACKGROUND AND SUMMARY OF THE INVENTION

It is well known that many chemical reactions are exothermic, i.e. they produce heat, and examples of such reactions include acid-base reactions The present invention makes use of a controlled exothermic reaction to produce heat which is then exchanged in a heat exchanger to provide a usable source of heat for heating a fluid such as the water in a domestic water supply Accordingly, in a first aspect, the invention provides a method for producing a supply of a heated fluid, which method comprises passing the fluid through a heat exchanger unit where it is heated by a heat source; characterised in that the heat source derives heat from the exothermic reaction of two or more chemical reactants The exothermic reaction may take place inside a reactor within the heat exchanger. Alternatively, the reactants may be mixed together in a vessel that is separate from the heat exchanger unit, and a stream of the mixed reactants and/or their reaction products may be passed through the heat exchanger to serve as the heat source In one embodiment, the invention provides a method for producing a supply of a heated fluid, which method comprises passing the fluid through a heat exchanger unit, wherein the heat exchanger unit comprises:

(a) a heat exchanger element through which the fluid may flow;

(b) a reaction chamber having at least one inlet through which reactants may be introduced into the reaction chamber, and at least one outlet through which spent reactant may be removed from the reaction chamber;

(c) a first dosing unit for introducing a controlled amount of a first reactant through an inlet into the reaction chamber; and (d) a second dosing unit for introducing a controlled amount of a second reactant through an inlet into the reaction chamber;

wherein the first and second reactants react exothermically and the heat thereby produced is exchanged with the fluid passing through the heat exchanger element, the introduction of the first and second reactants into the reaction chamber being controlled to produce a required level of heating.

The fluid can be a gas or a liquid.

In one embodiment, the fluid is a gas.

In another embodiment, the fluid is a liquid, one particular example of which is water.

The heat exchanger element is in thermal contact with the reaction chamber. In one embodiment, the heat exchanger element passes through the reaction chamber. For example, the heat exchanger element can take the form of a pipe passing through the reaction chamber.

It will be appreciated that the fluid does not come into contact with the reactants.

The reaction chamber has at least one inlet and at least one outlet. Each reactant may be provided with its own inlet. Alternatively, a pre-mixing chamber may be provided into which the first and second reactants are introduced prior to introducing them into the reaction chamber. It is preferred, however, that each reactant has its own inlet.

Dosing units are provided for introducing the first and second reactants into the reaction chamber in a controlled manner so as to produce a required level of heating. Each dosing unit can take the form of a container (e.g. a hopper or a tank) having an aperture that may be opened or closed to permit a reactant to move towards the reaction chamber. The or each reactant can be conveyed to the reaction chamber by means of a gravity feed. Alternatively or additionally, a pump or other conveying device (e.g. an auger or screw) may be used.

One or more sensors may be provided for measuring the temperature of the fluid when it exits the heat exchanger. The sensors are typically connected to a controller which may in turn be connected to the dosing units and/or a valve at each inlet into the reaction chamber. Sensors may also be provided for monitoring the rate of flow of reactants into the reaction chamber.

One or more reaction monitoring sensors may also be provided for monitoring the extent of reaction between the reactants. A reaction monitoring sensor (which may be for example a pH sensor) may be disposed in the vicinity of, or at, the or each outlet to determine whether or not the reaction between the reactants has been completed. The reaction monitoring sensor may be linked to the controller and/or directly to a valve or other closure device closing each outlet. The valve or other closure device may be actuated to an open position in response to a signal from the reaction monitoring sensor or the controller to allow spent reactant to exit the reaction chamber.

In each of the foregoing aspects and embodiments of the invention, the reactants (e.g. the first and second reactants) are preferably an acid and a base respectively.

The acid and base are preferably selected and/or formulated so as to provide an extended reaction time thereby giving a more prolonged release of heat.

Particular examples of acids are those having a pKa value of >0, more typically >2 and preferably >3, e.g. a pKa in the range 3 to 7. Where the acid is polybasic (e.g. citric acid), the foregoing limits refer to the first ionisation).

Particular acids are polybasic acids.

A preferred acid is citric acid.

Examples of bases are those having a pKb value of >0, more typically >2 and preferably >3, e.g. a pKb in the range 3 to 7.

Particular bases are basic amines and in particular mono-, di- and trialkylamines. The bases, particularly the more volatile amines such as ethylamine (boiling point 16.6° C.) may be provided in the form of an aqueous solution or a gel.

One group of preferred bases consists of mono-, di- and trialkylamines in which each alkyl group contains from 1 to 4 carbon atoms, more preferably 1 to 3 carbon atoms and most preferably 1 or 2 carbon atoms. Such bases include methylamine, dimethylamine, trimethylamine, ethylamine, diethylamine and triethylamine. Other bases that may be used include alkali metal hydroxides such as sodium hydroxide (caustic soda) and carbonates such as sodium carbonate A particularly preferred base is ethylamine, for example in the form of a 50-70% aqueous solution or gel.

The acid and base and/or their physical form are selected so that when they are mixed (e.g. introduced into the reaction chamber), they provide a sustained release of heat rather than a rapid sudden increase in temperature followed by a similarly rapid fall in temperature. The sustained release of heat may be achieved by using relatively weak acids or bases that react relatively slowly. Alternatively, or additionally, the acid and/or the base may be formulated and/or presented in a physical form whereby reaction between them is slowed down. For example, depending on the natural physical state of the acid and the base, they may be introduced in the form of coated particles (e.g. coated powders or granules) or gels in which the coatings or gel components slow down the reaction between the acid and bases.

In one embodiment, the base may be in liquid or gel form and the acid may be in solid form. One such combination of acid and base is the combination of citric acid in solid form and aqueous ethylamine.

In another embodiment, the base is in solid form and the acid is in liquid form.

The reaction between the acid and the base may be carried out in the absence of water or in the presence of water. In one embodiment, no water is added to the reaction mixture.

In one preferred mode of operation, where a reaction chamber forms part of the heat exchanger, metered amounts of the first and second reactants are introduced into reaction chamber and the temperature of the fluid (e.g. water) emerging from the heat exchanger is monitored, further metered amounts of the first and/or second reactants being introduced once the temperature of the fluid falls below a predetermined FIGURE.

In a further aspect, the invention provides a heat exchanger unit for heating a fluid, the heat exchanger unit comprising:

(a) a heat exchanger element through which the fluid may flow;

(b) a reaction chamber having at least one inlet through which reactants may be introduced into the reaction chamber, and at least one outlet through which spent reactant may be removed from the reaction chamber;

(c) a first dosing unit for introducing a controlled amount of a first reactant through an inlet into the reaction chamber; and (d) a second dosing unit for introducing a controlled amount of a second reactant through an inlet into the reaction chamber; and optionally (e) one or more sensors for (i) monitoring a parameter indicative of the completeness of the reaction between the reactants; and/or (ii) the temperature of the fluid and/or (iii) the rate of flow of reactants into the reaction chamber; and (f) a controller operatively linked to the one or more sensors for controlling flow of reactants into the chamber and flow of spent reactant out of the chamber.

The invention will now be illustrated in more detail (but not limited) by reference to the specific embodiment shown in the accompanying drawing.

BRIEF DESCRIPTION OF THE DRAWING

FIG. 1 is a schematic view of an apparatus according to one embodiment of the invention.

DETAILED DESCRIPTION OF THE INVENTION

As shown in FIG. 1, an apparatus for producing heat according to the method of the invention takes the form of a heat exchanger 2 comprising an insulated reaction chamber 4 and a heat exchanger element 6 in the form of a pipe for carrying water through the reaction chamber. The pipe may form part of a domestic water heating system and may be, for example linked to radiators or a hot water tank, or directly to a hot water tap. The pipe may also be insulated.

The reaction chamber has a pair of inlets 7 and 9 fed by inlet tubes 8 and 10 that are linked to hoppers 12 and 14. Control valves (not shown) are present in the inlet tubes to control the flow of reactants to the reaction chamber. The first hopper 12 contains a first reactant which may be, for example, powdered citric acid. The second hopper contains a second reactant which may be, for example, aqueous ethylamine or sodium carbonate. The functioning of the apparatus will be described below with reference to citric acid and aqueous ethylamine but it is to be understood that other acids and bases, and indeed other exothermal reaction couples, could be used instead.

Each of the inlet tubes 8 and 10 has a dosing sensor 13, 15, the purpose of which is to monitor the amounts of reactants entering the chamber. At the lower end of the reaction chamber is an outlet 16 which contains a filter to prevent larger particles of spent reactant from passing into the waste pipe. Arranged immediately above the outlet is a sensor 18 for measuring the pH of the reaction mixture. The outlet 16 is connected to a waste pipe 24 that carries spent reactants to a waste storage container (not shown).

In use, water (e.g. forming part of a domestic water supply) is pumped through the pipe 6 in the direction of the arrows. Citric acid in fluid form is gravity fed from the hopper 12 through the inlet tube 8 and inlet 7 into the reaction chamber 4. The quantity of citric acid introduced is measured by the dosing sensor 13 and the flow from the hopper is stopped by means of a valve once a predetermined amount of citric acid has passed into the reaction chamber 4. At the same time (or sequentially before or after the citric acid has been introduced), 50-70% aqueous ethylamine or an ethylamine-containing gel or sodium carbonate is fed from the hopper 14 through inlet tube 10 and inlet 9 into the reaction chamber 4. It is preferred that an excess of ethylamine is used so that the reaction mixture is in the form of a slurry thereby facilitating flow of the mixture through the reaction chamber towards the outlet. The citric acid reacts exothermically with the ethylamine to form a fluid. The heat given out by the reaction causes the contents of the reaction chamber to increase in temperature and, consequently, water passing through the pipe 6 is heated. Using the combination of citric acid and aqueous ethylamine, it has been found that a combined weight of 300 g of reactants produces an output of 1 kW and was able to heat 15 liters of water by 1° C. over a 5 hour period. Typically the heating effect available from a single charge of citric acid and single charge of ethylamine lasts between 4 hours and 24 hours.

The reaction chamber can be topped up with further charges of citric acid and aqueous ethylamine as necessary. A temperature gauge may be positioned in the pipe 6 downstream of the heat exchanger to monitor the temperature of the water. The temperature gauge may be linked to the controller 20. When the temperature falls below a predetermined value, the controller may actuate valves not (shown) to cause further charges of the citric acid and aqueous ethylamine to be introduced into the reaction chamber.

An advantage of using citric acid and aqueous ethylamine as the reactants is that the citric acid is a naturally occurring substance and hence is available from renewable sources. The ethylamine, whilst not commercially available from natural sources, can be subsequently be regenerated from the citrate salt isolated as the waste product from the reaction.

The heating method and apparatus of the invention can be used in situations where conventional energy sources for heating water are not available or may be used to supplement conventional energy sources. The only waste product from the method is a water soluble fluid or slurry that can be collected and taken away either for disposal or for recycling.

The embodiment illustrated in FIG. 1 represents merely one way of putting the invention into effect and it will readily be apparent that numerous modifications and alterations may be made to the specific embodiment shown without departing from the principles underlying the invention. All such modifications and alterations are intended to be embraced by this application.

The invention claimed is:

1. A method for producing a supply of heated water, the method comprising passing water through a heat exchanger unit, wherein the heat exchanger unit comprises:

(a) a heat exchanger element through which the water may flow;

(b) a reaction chamber having at least one inlet through which reactants may be introduced into the reaction chamber, and at least one outlet through which spent reactant may be removed from the reaction chamber;

(c) a first dosing unit for introducing a controlled amount of a first reactant through an inlet into the reaction chamber;

(d) a second dosing unit for introducing a controlled amount of a second reactant through an inlet into the reaction chamber;

wherein the first and second reactants react exothermically and the heat thereby produced is exchanged with the water passing through the heat exchanger element, the introduction of the first and second reactants into the reaction chamber being controlled to produce a required level of heating;

(e) sensors which in use monitor the rates of flow of the first and second reactants into the reaction chamber;

(f) one or more sensors for measuring the temperature of the water;

(g) one or more reaction monitoring sensors for monitoring the extent of reaction between the reactants; and (h) a controller operatively linked to the temperature-measuring sensors, the reaction monitoring sensors and the sensors for controlling the flow of the first and second reactants into the chamber so as to produce a required level of heating of the water, and for controlling the flow of spent reactant out of the reaction chamber.

2. A method according to claim 1 wherein the exothermic reaction takes place inside a reactor within the heat exchanger.

3. A method according to claim 1 wherein the reactants are mixed together in a vessel that is separate from the heat exchanger and a stream of one of the mixed reactants and their reaction products is passed through the heat exchanger.

4. A method according to claim 1 wherein the heat exchanger element passes through the reaction chamber.

5. A method according to claim 4 wherein the heat exchanger element comprises a pipe passing through the reaction chamber.

6. A method according to claim 1 wherein each reactant is provided with its own inlet.

7. A method according to claim 1 wherein each dosing unit comprises a container having an aperture to permit a reactant to move towards the reaction chamber.

8. A method according to claim 1 wherein the reactants comprise an acid and a base.

9. A method according to claim 1 wherein metered amounts of the first and second reactants are introduced into the reaction chamber and the temperature of the water emerging from the heat exchanger is monitored, further metered amounts of the first and/or second reactants being introduced once the temperature of the water falls below a predetermined FIGURE.

10. A heat exchanger unit for heating water, the heat exchanger unit comprising:

(a) a heat exchanger element through which the water may flow;

(b) a reaction chamber having at least one inlet through which reactants may be introduced into the reaction chamber, and at least one outlet through which spent reactant may be removed from the reaction chamber;

(c) a first dosing unit for introducing a controlled amount of a first reactant through an inlet into the reaction chamber; and (d) a second dosing unit for introducing a controlled amount of a second reactant through an inlet into the reaction chamber;

wherein, in use, the first and second reactants react exothermically and the heat thereby produced is exchanged with the water passing through the heat exchanger element, the introduction of the first and second reactants into the reaction chamber being controlled to produce a required level of heating;

(e) sensors which in use monitor the rates of flow of the first and second reactants into the reaction chamber;

(f) one or more sensors for measuring the temperature of the water;

(g) one or more reaction monitoring sensors for monitoring the extent of reaction between the reactants; and (h) a controller operatively linked to the temperature-measuring sensors, the reaction monitoring sensors and the sensors for controlling the flow of the first and second reactants into the chamber so as to produce a required level of heating of the water, and for controlling the flow of spent reactant out of the reaction chamber.

11. A heat exchanger unit according to claim 10 wherein a pre-mixing chamber is provided into which the first and second reactants are introduced prior to introducing them into the reaction chamber.

12. A heat exchanger unit according to claim 10 wherein said reaction monitoring sensor is disposed in the vicinity of, or at, the or each outlet to determine whether or not the reaction between the reactants has been completed.

13. A heat exchanger unit according to claim 10 wherein the reaction monitoring sensor is a pH sensor.

14. A heat exchanger unit according to claim 10 wherein the heat exchanger element passes through the reaction chamber.

15. A heat exchanger unit according to claim 10 wherein each reactant is provided with its own inlet.

16. A heat exchanger unit according to claim 10 wherein the dosing units take the form of a container having an aperture that may be opened or closed to permit a reactant to move towards the reaction chamber.

* * * * *